United States Patent [19]

Cormier

[11] Patent Number: 5,067,197

[45] Date of Patent: Nov. 26, 1991

[54] SNOW RAKE

[76] Inventor: Frederick P. Cormier, 10 Overlook Dr., Spencer, Mass. 01562

[21] Appl. No.: 588,611

[22] Filed: Sep. 26, 1990

[51] Int. Cl.[5] ..... A47L 13/46

[52] U.S. Cl. ..... 15/244.1; 15/245; 37/285; 294/54.5; 403/408.1

[58] Field of Search ..... 15/117, 121, 236.01, 15/236.02, 236.05, 244.1, 244.2, 245; 403/373, 405.1, 408.1; 37/278, 284, 285; 56/400.01, 400.04, 400.16–400.18; 294/54.4

[56] References Cited

U.S. PATENT DOCUMENTS

| | | | |
|---|---|---|---|
| 302,832 | 7/1884 | Ferguson | 15/245 |
| 1,395,863 | 11/1921 | Nelson | 15/245 |
| 1,574,666 | 2/1926 | Lynch | 15/245 |
| 1,747,180 | 2/1930 | Raynor | 15/245 |
| 1,750,845 | 3/1930 | Lach . | |
| 2,284,528 | 5/1942 | Malmquist | 15/245 |
| 2,639,454 | 5/1953 | Dory | 15/245 |
| 2,728,099 | 12/1955 | Cocco | 15/245 |
| 2,880,443 | 4/1959 | Le Febvre | 15/244 |
| 2,946,076 | 7/1959 | Morgan . | |
| 3,274,635 | 9/1966 | Myers | 15/244 |
| 3,649,987 | 3/1972 | Tomingas | 15/245 |
| 3,717,898 | 2/1973 | Jones . | |
| 4,103,383 | 8/1978 | Martin | 15/245 |
| 4,114,224 | 9/1978 | Disko . | |
| 4,317,250 | 2/1982 | Shutts . | |
| 4,321,724 | 3/1982 | Samuels | 15/245 |
| 4,547,011 | 10/1985 | Stewart, Jr. . | |
| 4,550,943 | 11/1985 | Mirto . | |
| 4,848,819 | 7/1989 | Moorefield . | |
| 4,947,562 | 8/1990 | Williamson . | |

FOREIGN PATENT DOCUMENTS

| | | | |
|---|---|---|---|
| 258072 | 3/1913 | Fed. Rep. of Germany | 403/408.1 |

*Primary Examiner*—Timothy F. Simone
*Assistant Examiner*—Mark Spisich
*Attorney, Agent, or Firm*—Blodgett & Blodgett

[57] ABSTRACT

Snow rake having a generally rectangular main body formed of a closed-cell, resilient, low-density polyethylene bead, which main body is clamped between two spaced, parallel plates to one of which a handle is attached.

8 Claims, 2 Drawing Sheets

SNOW RAKE

BACKGROUND OF INVENTION

In those portions of the world where snow falls frequently during the winter months, the problem arises that it is necessary and desirable to remove freshly-fallen snow from various places, including house roofs, playing surfaces, and particularly things with sensitive, polished surfaces. Such surfaces exist, for instance, in connection with the painted horizontal parts of an automobile. Any attempt to remove the snow from an automobile can cause unsightly scratches on the highly-finished hood, trunk, and roof. Not only do such scratches give the automobile a shabby appearance, but the penetration of the coat of paint can start rust action that eventually can cause deterioration of the sheet metal underlying the paint. The problem is particularly acute at an automobile sales agency, because the automobiles are commonly stored and displayed in the open air; at the same time, in order to attract customers, it is necessary to remove the new snow immediately. This is true, not only because of the need to display the vehicles attractively, but because the failure to remove the snow often leads to the snow melting during the daytime and then freezing during the night, so that the accumulation becomes extremely difficult to remove later without damaging the finish of the automobiles.

Devices have been developed in the past to remove such an accumulation of snow, but they have not been entirely suitable for a number of reasons. For instance, they have been constructed in the manner shown in the patent of SHUTTS U.S. Pat. No. 4,317,250, in which the 2-part construction can come apart at the seams so that cracks and crevices appear along the scraping edge and these crevices tend to accumulate dirt and ice crystals; these act like grit particles and can scratch a polished paint surface. In the case of new automobiles before they have been sold, the result is costly to the sales agency. The crevices also absorb water which freezes and damages the device, thus making the situation worse. In addition, the prior art snow removal devices have been expensive, because of complexities of manufacture and cost of materials. These and other difficulties experienced with the prior art devices have been obviated in a novel manner by the present invention.

It is, therefore, an outstanding object of the invention to provide a snow rake which will not injure delicate surfaces.

Another object of this invention is the provision of a snow rake having a scraping edge which has no cracks or crevices that can accumulate gritty materials.

A further object of the present invention is the provision of a snow rake whose operative edge combines strength with smoothness.

A still further object of the invention is the provision of a snow removal device which is simple and rugged in construction, which is inexpensive to manufacture from readilyobtainable materials, and which is capable of a long life of useful service with a minimum of maintenance.

It is a further object of the invention to provide a snow rake which is constructed in such a way that considerable force can be applied to a snow accumulation without bending the operative parts of the rake.

Another object of the invention is the provision of a snow rake that can be neglected in the season when it is not used, but continues to retain its usefulness.

With these and other objects in view, as will be apparent to those skilled in the art, the invention resides in the combination of parts set forth in the specification and covered by the claims appended hereto.

SUMMARY OF THE INVENTION

In general, the invention consists of a snow rake having a main body of generally elongated rectangular profile with the sides acting as scraping edges. An elongated handle is fastened to and extends perpendicularly of the main body. The main body is formed as a single integral piece from a closed-cell, low-density polymer, such as resilient polyethylene bead and the scraping edges are formed without cracks.

More specifically, the main body is clamped between two substantially smaller plates that are joined together through the main body. The handle is attached to one of the plates. The main body is provided with a back surface with angled portions from which the handle extends and with a front surface with angled portions. The scraping edges are generally formed at the intersections of the angular portions.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
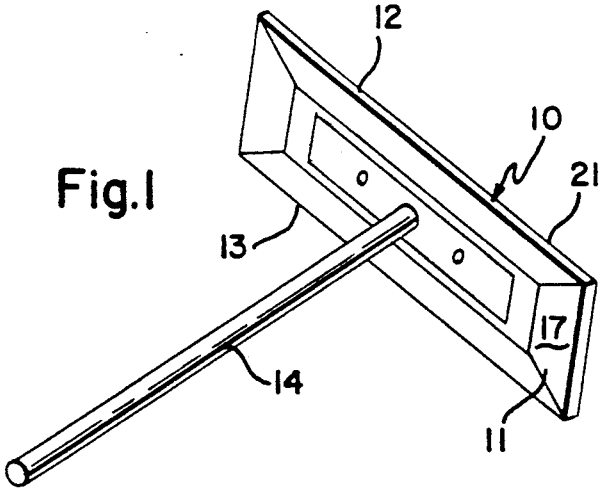
FIG. 1 is a perspective view of a snow rake incorporating the principles of the present invention.
Figure 2:
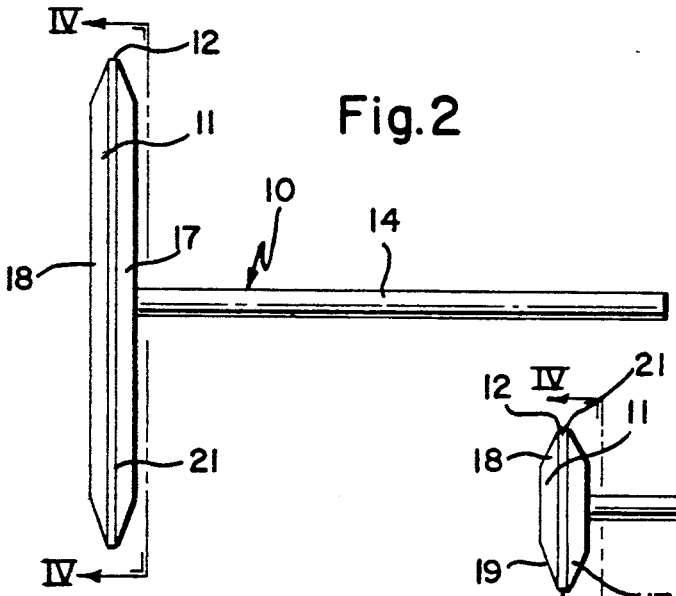
FIG. 2 is a plan view of the snow rake.
Figure 3:
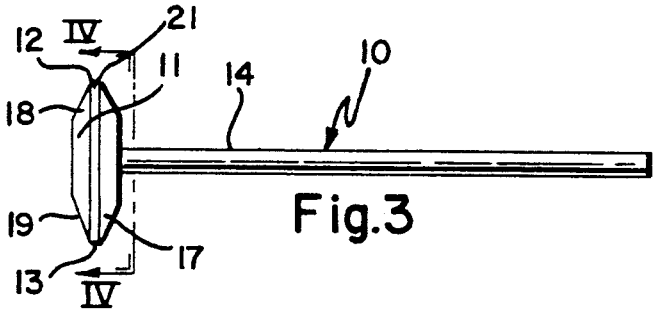
FIG. 3 is a side elevational view of the snow rake.

Referring first to FIGS. 1-3, which best show the general features of the invention, the snow rake, indicated generally by the reference numeral 10, is shown as consisting of a main body 11 and a handle 14. The main body has a generally elongated rectangular shape with long sides constituting scraping edges 12 and 13. These scraping edges are formed smoothly without crevices or cracks.

The main body 11 is formed (in the preferred embodiment) by injection molding or the like as a single integral piece of closed-cell, low-density polyethylene. The material is known as "RMB" (resilient molded beads). This material is excellent because of consistency, tensile strength, and non-abrasive characteristics.

Figure 4:
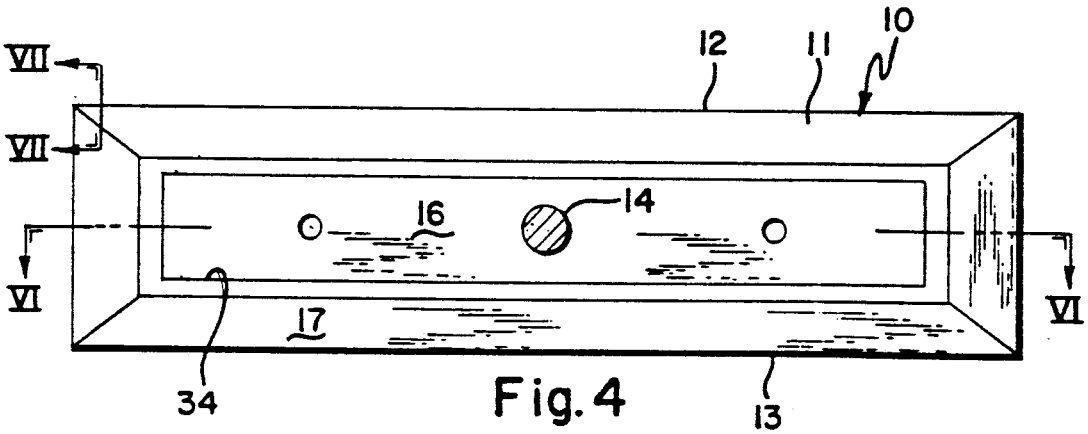
FIG. 4 is a partial sectional view of the snow rake, taken on the line IV—IV of FIG. 2.
Figure 5:
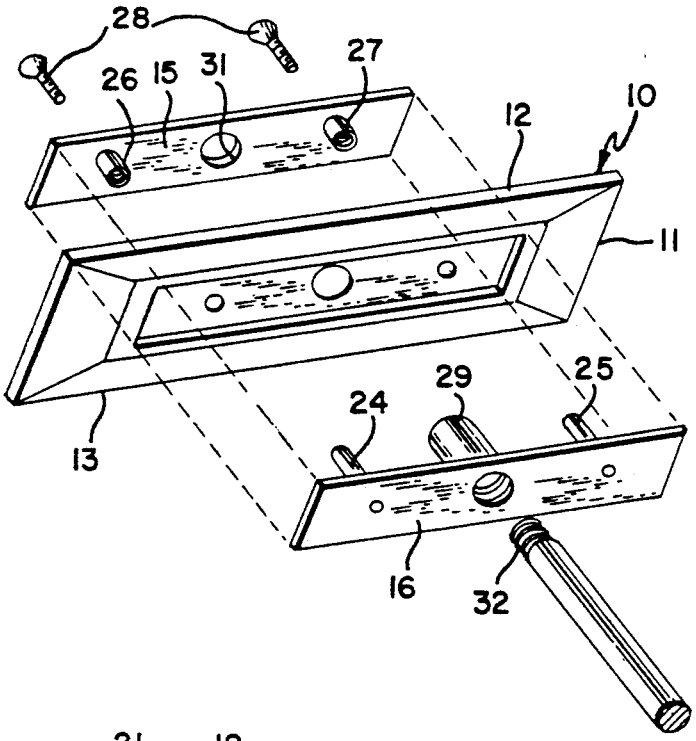
FIG. 5 is an exploded perspective view of the snow rake.

FIGS. 4 and 5 demonstrate the manner in which the main body 11 is clamped between two, substantially smaller rectangular rigid plates 15 and 16 that are joined together by elements extending through the main body. The handle 14 is attached to the plate 16.

As is particularly evident in FIG. 3, the main body 11 has a cross-sectional configuration in the general shape of a diamond, the handle 14 extending at a right angle from a broad, flat back surface 17, the scraping edges 12 and 13 are formed by the intersection of angular surfaces 18 and 19 of the front surface with similar angular surfaces on the said back surface.

Figure 7:
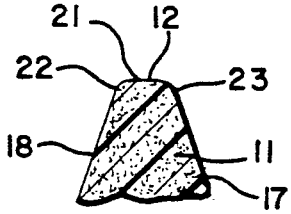
FIG. 7 is a somewhat enlarged sectional view of a portion of the snow rake, taken on the line VII—VII of FIG. 4.
Figure 6:
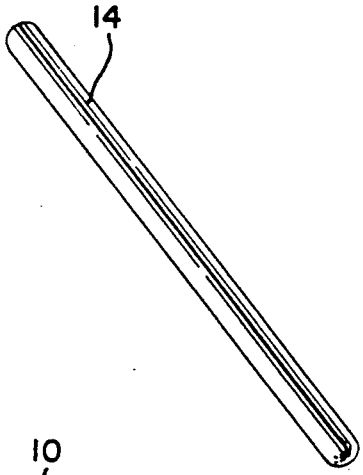
FIG. 6 is a sectional view of the snow rake, taken on the line VI—VI of FIG. 4.
Figure 6:
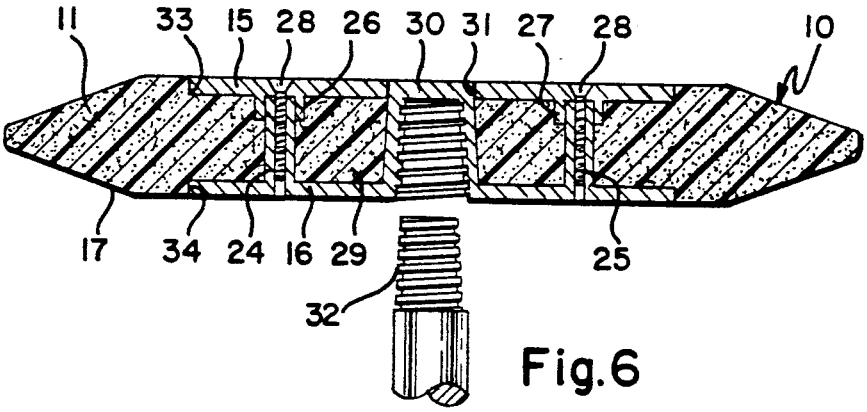

The enlarged cross-sectional view of the edge 12, shown in FIG. 7, shows that it is formed with a narrow flat surface 21 which extends at a right angle to the back surface 17 and which is joined to the back surface 17 and the angular surface 18 by rounded corner surfaces 23 and 22 respectively. In the preferred embodiment, the main body is 36" long, 1½" thick, and 12" wide.

In FIG. 5, it can be seen that the back plate 16 is provided with spaced tubular elements 24 and 25, while the front plate 15 is similarly provided with tubular elements 26 and 27. The tubular elements 24 and 26 are telescopingly joined and held together by a self-tapping screw 28. The tubular elements 25 and 27 are similarly joined in telescoping relationship and connected by a self-tapping screw 28.

The back plate 16 is provided with a central threaded tube 29 having a closed end 30 residing in an aperture 31 in the front plate 15. The handle 14 has a threaded portion 32 by which it is joined to the tube. The plates are injection molded of high-density polyethylene, which has excellent properties in cold weather. Each plate is approximately 2" wide and 12" long.

The main body 11 is formed with rectangular recesses 33 and 34 on the front and rear surfaces, respectively. The recesses are of the proper shape and size to completely envelope and receive the plates 15 and 16.

The operations and advantages of the invention will now be readily understood in view of the above description. Normally, the snow rake 10 would be sold (and, perhaps, even stored) with the main body 11 separate from the handle 14. In order to assemble the two parts, it is only necessary to thread the threaded portion 32 of the handle into the threaded tube 29. The assembled unit can then be used to rake or scrape snow from horizontal surfaces. It is particularly useful in cleaning the horizontal painted surfaces of an automobile, since it will not damage the sensitive painted surfaces. The scraping edges 12 or 13 can be passed over the surface, while the back surface 17 collects the snow. A considerable quantity of snow can be dragged from the surface without it slipping from the rake. On the other hand, because of the matched trapezoidal shapes of the front and back surfaces, the foamed polyethylene main body is quite rigid, so that substantial raking force can be applied without bending or breakage.

Now, the shape of the scraping edge is very important. To begin with, because the main body 11 is formed in one piece (instead of being laminated from two pieces), there is no possibility of seams splitting where the two pieces are joined. The result is that there are no crevices or small cavities that can accumulate dirt that might act as abrasive grits. Even ice crystals do not have an opportunity to form and be held in place as a scratching agent. Since the edges 12, **12*a*, 13 and 13*a* are formed with a blunt conformation, the edge has considerable transverse strength to resist bending and damage. As the rake advances over the polished surface of the hood of an automobile, for instance, the corner surfaces 22 and 23** are quite capable of scraping the surface clear of snow without themselves being worn by the action. The edges are unlikely to shred and become less effective, as has been the case with devices of this type that have been made from two or more pieces.

Because the main body 11 and the plates 15 and 16 are formed of inexpensive polymers, they can be manufactured cheaply. Assembly also requires very little hand labor and is not costly.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A snow rake comprising:

(a) an elongated generally rectangular single, integral main body of resilient low density foamed thermoplastic material, said main body having a broad front surface and broad back surface, and at least one narrow scraping edge, said front surface having a shallow front recess, said back surface having a shallow back recess, (b) a rigid flat front plate of high density solid thermoplastic material which lies in said front recess, (c) a rigid flat back plate of high density solid thermoplastic material which lies in said back recess, (d) an elongated handle which is removably attached to said back plate so that the handle extends substantially at a right angle to said back surface, and (e) connecting means for fixing said front plate to said back plate so that said main body is clamped between said front and back plates.

2. A snow rake as recited in claim 1, wherein the thermoplastic material of said main body is polyethylene.

3. A snow rake as recited in claim 1, wherein said main body has a central bore which extends at a right angle to said front and back surfaces, said back plate has a tubular projection which extends into said bore, said tubular projection has internal threads and a rearwardly facing opening and, wherein one end of said handle has external threads for screwing into said tubular projection.

4. A snow rake as recited in claim 1, wherein said main body has at least one aperture which extends from said front plate to said back plate, wherein one of said plates has at least one projection which extends to the other of said plates and, wherein said projection is connected to the other of said plates by fastening means.

5. A snow rake as recited in claim 4, wherein said projection is a primary projection and the other of said plates has a tubular projection which receives said primary projection in a telescoping fit.

6. A snow rake comprising:

(a) an elongated generally rectangular single integral main body of relatively soft thermoplastic material, said main body having a broad front surface and a broad back surface, at least one narrow scraping edge, a central aperture and at least one secondary aperture, (b) a flat front plate of relatively hard thermoplastic material which lies against said broad front surface, said front plate having a central projection which extends into said central aperture and a secondary projection which extends rearwardly into said secondary aperture, said central projection has a threaded bore and a front opening to the bore, (c) a flat rear plate of relatively hard thermoplastic material which lies against said back surface, said back plate having at least one secondary projection which extends forwardly into said secondary aperture for engaging the secondary projection of said front plate, and (d) fastening means for fixing the secondary projection of said back plate to the secondary projection of said front plate so that said main body is clamped between said front and back plates.

7. A snow rake as recited in claim 6, wherein one of said secondary projections has a bore and an opening to the bore and the other of said secondary projections extends into the bore of said one projection in a telescoping fit.

8. A snow rake as recited in claim 7, wherein said fastening means is a screw which extends freely through one of said secondary projections and is threaded into the other of said secondary projections.

* * * * *